US010578377B2

(12) United States Patent
Abastari

(10) Patent No.: US 10,578,377 B2
(45) Date of Patent: Mar. 3, 2020

(54) HEAT EXCHANGER AND REFRIGERATION CYCLE APPARATUS

(71) Applicant: Mitsubishi Electric Corporation, Tokyo (JP)

(72) Inventor: Abastari, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/072,215

(22) PCT Filed: Mar. 31, 2016

(86) PCT No.: PCT/JP2016/060624

§ 371 (c)(1),
(2) Date: Jul. 24, 2018

(87) PCT Pub. No.: WO2017/168669

PCT Pub. Date: Oct. 5, 2017

(65) Prior Publication Data

US 2019/0033017 A1 Jan. 31, 2019

(51) Int. Cl.
*F28D 7/06* (2006.01)
*F28F 9/02* (2006.01)
(Continued)

(52) U.S. Cl.
CPC ..... *F28F 9/027* (2013.01); *F25B 39/00* (2013.01); *F28D 1/047* (2013.01); *F28F 1/32* (2013.01);
(Continued)

(58) Field of Classification Search
CPC .. F28F 9/027; F28F 1/32; F28F 6/0246; F28F 2210/02; F25B 39/00; F25B 39/02; F25B 39/04; F28D 1/047; F28D 2021/0068
(Continued)

(56) References Cited

U.S. PATENT DOCUMENTS 4,483,156 A * 11/1984 Oudenhoven ..... F25B 39/00 62/324.1
5,038,854 A * 8/1991 Peterson, III ..... F28D 1/047 165/125

(Continued)

FOREIGN PATENT DOCUMENTS

JP S62-108971 A 5/1987
JP H07-218177 A 8/1995
JP 2006-336936 A 12/2006

OTHER PUBLICATIONS

International Search Report ("ISR") dated Jun. 14, 2016 issued in corresponding International patent application No. PCT/JP2016/060624 (with English translation).

*Primary Examiner* — Claire E Rojohn, III
(74) *Attorney, Agent, or Firm* — Posz Law Group, PLC

(57) ABSTRACT

A heat exchanger includes a heat exchange portion including a plurality of plate-shaped fins and a plurality of heat transfer pipes, the plate-shaped fins being spaced from each other and parallel to each other, the heat transfer pipes intersecting the plate-shaped fins, a header pipe which supplies refrigerant to the heat exchange portion, and a plurality of pass pipes connected between the heat exchange portion and the header pipe. The plurality of pass pipes include at least one pass pipe including a first straight pipe part extending in a direction away from the header pipe, a first bent pipe part extending from the first straight pipe part, a second straight pipe part extending in a direction away from a pipe junction which at which the heat exchange portion and the second straight pipe are connected to each other, a second bent pipe part extending from the second straight pipe part, and a third straight pipe part extending between the first bent pipe part and the second bent pipe part. The first bent pipe part has a bending angle of less than 90 degrees. A refrigeration cycle apparatus includes the above heat exchanger.

8 Claims, 11 Drawing Sheets

(51) Int. Cl.

| | |
|---|---|
| ***F28D 1/047*** | (2006.01) |
| ***F28F 1/32*** | (2006.01) |
| ***F25B 39/00*** | (2006.01) |
| *F25B 39/04* | (2006.01) |
| *F28D 21/00* | (2006.01) |
| *F25B 39/02* | (2006.01) |

(52) U.S. Cl.
CPC ..... *F28F 9/0246* (2013.01); *F25B 39/02* (2013.01); *F25B 39/04* (2013.01); *F28D 2021/0068* (2013.01); *F28F 2210/02* (2013.01)

(58) Field of Classification Search
USPC ..... 165/176
See application file for complete search history.

(56) References Cited

U.S. PATENT DOCUMENTS 5,076,353 A * 12/1991 Haussmann ..... F25B 39/04 165/110
8,763,424 B1 * 7/2014 Albertson ..... F25B 39/028 62/498
9,528,769 B2 * 12/2016 Sakashita ..... F24F 1/0007
10,156,387 B2 * 12/2018 Kwon ..... F25B 13/00
10,161,656 B2 * 12/2018 Cho ..... F28F 9/0275
10,386,081 B2 * 8/2019 Yokozeki ..... F25B 40/02
10,415,886 B2 * 9/2019 Choi ..... F28F 9/001
2011/0203308 A1 * 8/2011 Chiang ..... F25B 39/028 62/498
2013/0000347 A1 * 1/2013 Jin ..... F28D 1/0475 62/498
2013/0126127 A1 * 5/2013 Yoshimura ..... F28F 7/02 165/104.19
2013/0292098 A1 * 11/2013 Jindou ..... F28F 13/06 165/143
2013/0306285 A1 * 11/2013 Jindou ..... F25B 39/00 165/173
2013/0327503 A1 * 12/2013 Koch ..... F25B 39/00 165/104.21
2014/0138065 A1 * 5/2014 Hotti ..... F25B 39/022 165/109.1
2014/0262167 A1 * 9/2014 Kuo ..... F28F 9/0132 165/133
2015/0059401 A1 * 3/2015 Matsuda ..... F28F 9/0204 62/498
2015/0101363 A1 * 4/2015 Matsuda ..... F25B 39/028 62/525
2016/0025384 A1 * 1/2016 Kimura ..... F25B 13/00 62/160
2016/0033179 A1 * 2/2016 Kim ..... F25B 13/00 62/324.6
2016/0054038 A1 * 2/2016 Matsui ..... F25B 13/00 62/498
2016/0076815 A1 * 3/2016 Chen ..... F28F 1/32 165/181
2016/0123645 A1 * 5/2016 Kim ..... F25B 49/02 62/115
2016/0223265 A1 * 8/2016 Jindou ..... F24F 1/18
2016/0245596 A1 * 8/2016 Higashiiue ..... F25B 39/00
2016/0348951 A1 * 12/2016 Matsumura ..... F28F 1/32
2017/0234587 A1 * 8/2017 Jindou ..... F28F 9/02 62/527
2017/0261244 A1 * 9/2017 Schutte ..... F25B 39/02
2018/0058736 A1 * 3/2018 Jin ..... F16L 13/141
2018/0073809 A1 * 3/2018 Seo ..... F28F 9/0214

* cited by examiner

HEAT EXCHANGER AND REFRIGERATION CYCLE APPARATUS

CROSS REFERENCE TO RELATED APPLICATION

This application is a U.S. national stage application of PCT/JP2016/060624 filed on Mar. 31, 2016, the contents of which are incorporated herein by reference.

TECHNICAL FIELD

The present invention relates to a fin-and-tube heat exchanger and a refrigeration cycle apparatus provided with the heat exchanger.

BACKGROUND ART

As a conventional fin-and-tube heat exchanger, for example, patent literature 1 discloses a heat exchanger which includes heat exchange fins, a tubular wall substantially surrounding the heat exchange fins, and a conduit extending through the heat exchange fins and the tubular wall. In the heat exchanger disclosed in patent literature 1, thermal strain occurs in the conduit because of the difference between the tubular wall and the heat exchanger. In order to reduce a thermal stress caused by the thermal strain of the conduit, the tubular wall of the heat exchanger disclosed in patent literature 1 includes groove-shaped absorbers.

CITATION LIST

Patent Literature

Patent Literature 1: Japanese Unexamined Patent Application Publication No. 7-218177

SUMMARY OF INVENTION

Technical Problem

However, in the fin-and-tube heat exchanger disclosed in patent literature 1, for example, if part of the conduit is bent and extends in the same direction as the groove-shaped absorbers, the thermal stress cannot be reduced by the absorbers. Therefore, in the fin-and-tube heat exchanger disclosed in patent literature 1, whether the thermal stress can be reduced or not depends on the shape of the conduit; that is, there is a case where the thermal stress cannot be reduced.

Furthermore, in another conventional fin-and-tube heat exchanger, a heat exchange medium is supplied to a plurality of heat transfer pipes through pass pipes extending from a header pipe. In such a fin-and-tube heat exchanger, there is a case where the pass pipes extending from the header pipe are bent at a right angle at their midway portions, and partially extend in the same direction as the longitudinal direction of the header pipe. In the case where the pass pipes partially extend in the same direction as the longitudinal direction of the header pipe, as the case may be, a great thermal stress acts on junctions between the pass pipes and the heat transfer pipes due to thermal strain of the header pipe and the pass pipes. Therefore, there is a case where the conventional fin-and-tube heat exchanger cannot ensure reliability if a thermal stress acts on the junctions between the pass pipes and the heat transfer pipes.

The present invention has been made to solve the above problems, and an object of the invention is to provide a heat exchanger and a refrigeration cycle apparatus which are capable of reducing a thermal stress and ensuring reliability against the thermal stress, even if part of a pipe of the heat exchanger is bent.

Solution to Problem

A heat exchanger according to an embodiment of the present invention includes: a heat exchange portion including a plurality of plate-shaped fins and a plurality of heat transfer pipes, the plurality of plate-shaped fins being spaced apart from each other and parallel to each other, the plurality of heat transfer pipes intersecting the plurality of plate-shaped fins; a header pipe which supplies refrigerant to the heat exchange portion; and a plurality of pass pipes connected between the heat exchange portion and the header pipe. The plurality of pass pipes include at least one pass pipe including a first straight pipe part extending in a direction away from the header pipe, a first bent pipe part extending from the first straight pipe part, a second straight pipe part extending in a direction away from a pipe junction at which the heat exchange portion and the second straight pipe part are connected to each other, a second bent pipe part extending from the second straight pipe part, and a third straight pipe part extending between the first bent pipe part and the second bent pipe part. The bending angle of the first bent pipe part is less than 90 degrees.

A refrigeration cycle apparatus according to an embodiment of the present invention includes the above heat exchanger.

Advantageous Effects of Invention

According to an embodiment of the present invention, a bending angle of a first bent pipe part is set to less than 90 degrees, to thereby reduce a thermal stress on a pipe junction, and thus reduce the possibility of the pipe junction being cracked or broken due to thermal fatigue. The embodiment of the present invention can therefore provide a heat exchanger and a refrigeration cycle apparatus that are capable of ensuring reliability even if a thermal stress is generated.

DESCRIPTION OF EMBODIMENTS

Embodiment 1

Figure 1:
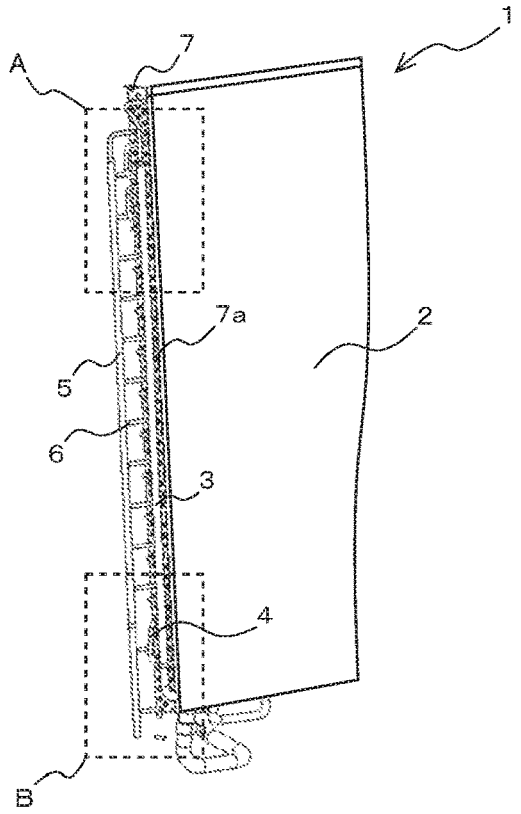
FIG. 1 is a perspective view schematically illustrating part of the configuration of a heat exchanger 1 according to embodiment 1 of the present invention.

The configuration of a heat exchanger 1 according to embodiment 1 of the present invention will be described. FIG. 1 is a perspective view schematically illustrating part of the configuration of the heat exchanger 1 according to embodiment 1. In FIG. 1, part of an upper end portion of the heat exchanger 1 is illustrated as a region A which is surrounded by a rectangular dashed line. In addition, part of a lower end portion of the heat exchanger 1 is illustrated as a region B which is surrounded by a rectangular dashed line.

It should be noted that that in the figures from FIG. 1 onward, the shapes of components and the relationship in dimension between them may differ from the actual ones. Also, in the figures, the same or similar components or parts are designated by the same reference signs, or the reference signs for the identical or similar components or parts are omitted. The positional relationship between the components, for example, that in the vertical direction, is in principle a positional relationship established when the heat exchanger 1 is set available.

The heat exchanger 1 is formed as an air-cooled fin-and-tube heat exchanger. As illustrated in FIG. 1, the heat exchanger 1 includes a heat exchange portion 2, which corresponds to a region for heat exchange with air passing through the heat exchanger 1. The heat exchanger 1 includes a first header pipe 3 and a second header pipe 5 which are arranged on one side of the heat exchange portion 2 as viewed from a direction in which air passes through the heat exchanger 1. Referring to FIG. 1, the first header pipe 3 and the second header pipe 5 are arranged on the left side of the heat exchanger 1. In addition, a side plate 7 having a plurality of punched holes 7*a* is disposed between the heat exchange portion 2 and the first header pipe 3 and between the header exchange portion 2 and the second header pipe 5.

A plurality of first pass pipes 4 are connected between the heat exchange portion 2 and the first header pipe 3. Furthermore, a plurality of second pass pipes 6 are connected between the heat exchange portion 2 and the second header pipe 5.

The connection of the first pass pipes 4 to the heat exchange portion 2 will be described with reference to FIG. 2.

Figure 2:
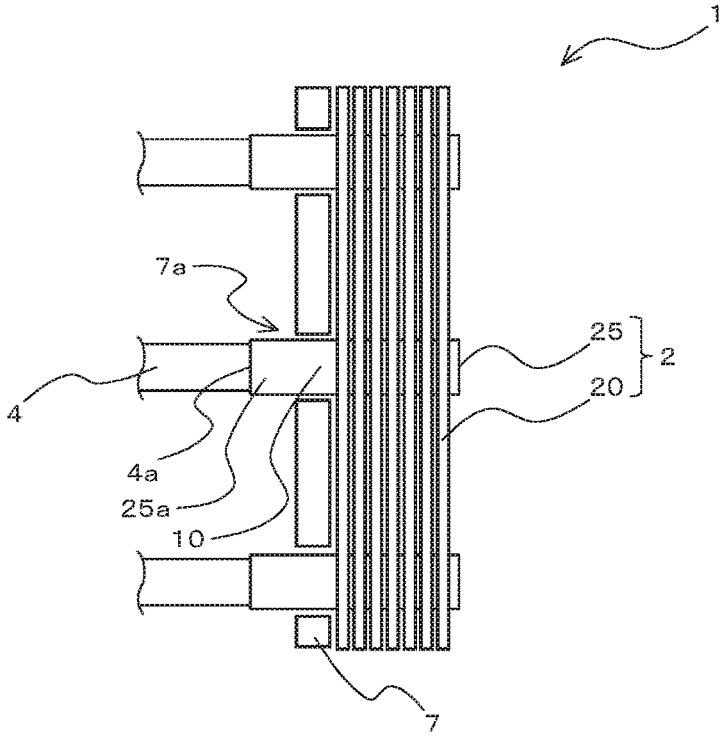
FIG. 2 is a schematic diagram illustrating an example of a pipe connection between a heat exchange portion 2 and first pass pipes 4 in the heat exchanger 1 according to embodiment 1 of the present invention.

FIG. 2 is a schematic diagram illustrating an example of the connection between the first pass pipes 4 and the heat exchange portion 2 in the heat exchanger 1 according to embodiment 1. As illustrated in FIG. 2, the heat exchange portion 2 includes a plurality of plate-shaped fins 20 arranged in parallel with each other and spaced from the side plate 7, and a plurality of heat transfer pipes 25 intersecting the plate-shaped fins 20. In the heat exchange portion 2, the plate-shaped fins 20 are spaced from each other, and air flowing through gaps between the adjacent plate-shaped fins 20 exchanges heat with a heat exchange medium, such as refrigerant, which flows in the heat transfer pipes 25. Although it is not illustrated, the heat transfer pipes 25 can be formed as, for example, U-shaped bent pipes which are hairpin-shaped.

The first pass pipes 4 each have an end portion 4*a*, which is connected to one end portion 25*a* of an associated one of the heat transfer pipes 25, which protrude from the punched holes 7*a* of the side plate 7. In the following description, a pipe junction where the end portion 25*a* of each heat transfer pipe 25 is joined to an associated one of the punched holes 7*a* of the side plate 7 is referred to as a pipe junction 10.

Although it is not illustrated, the second pass pipes 6 each have an end portion that is connected to the other end portion of an associated one of the heat transfer pipes 25 protruding from the punched holes 7*a* of the side plate 7 in the same manner as in the end portion 4*a* of the first pass pipe 4.

The configuration of the first pass pipes 4 in the vicinity of the both ends of the first header pipe 3 and that of the second pass pipes 6 in the vicinity of the both ends of the second header pipe 5 will be described with reference to FIGS. 3 to 5.

Figure 3:
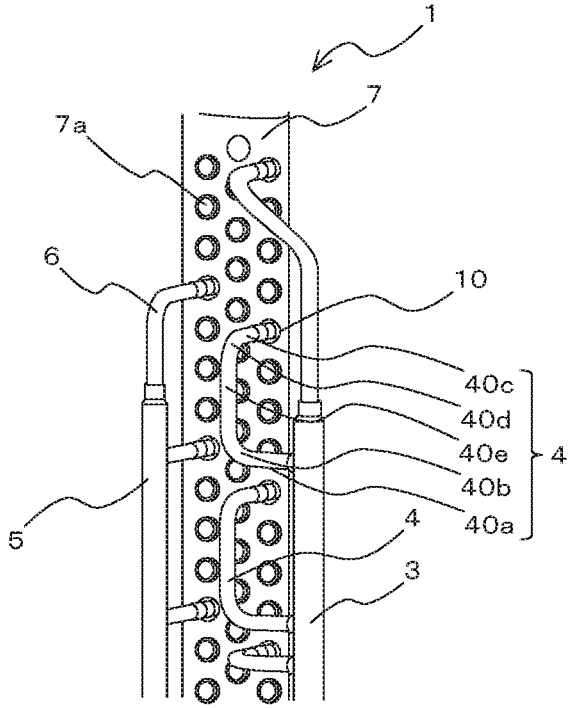
FIG. 3 is a schematic diagram illustrating an example of the configuration of first pass pipes 4 and a second pass pipe 6 which are located in the vicinity of one end of each of a first header pipe 3 and a second header pipe 5 in the heat exchanger 1 according to embodiment 1 of the present invention.

FIG. 3 is a schematic diagram illustrating an example of the configuration of the first pass pipes 4 and the second pass pipes 6 in the vicinity of one end of each of the first header pipe 3 and the second header pipe 5 in the heat exchanger 1 according to embodiment 1. FIG. 4 is a schematic diagram illustrating an example of the configuration of the first pass pipes 4 and the second pass pipes 6 in the vicinity of an other end of each of the first header pipe 3 and the second header pipe 5 in the heat exchanger 1 according to embodiment 1. FIG. 5 is a schematic diagram illustrating another example of the configuration of the first pass pipes 4 and the second pass pipes 6 in the vicinity of the other end of each of the first header pipe 3 and the second header pipe 5 in the heat exchanger 1 according to embodiment 1.

FIG. 3 illustrates an example of the configuration of the first pass pipes 4 and the second pass pipes 6 in the region A as illustrated in FIG. 1, that is, in the vicinity of the one end of each of the first header pipe 3 and the second header pipe 5. FIG. 4 illustrates an example of the configuration of the first pass pipes 4 and the second pass pipes 6 in the region B as illustrated in FIG. 1, that is, in the vicinity of a lower end of each of the first header pipe 3 and the second header pipe 5. FIG. 5 illustrates a modification of the configuration of the first pass pipes 4 in the region B as illustrated in FIG. 1, or a modification of the configuration as illustrated in FIG. 4.

Figure 4:
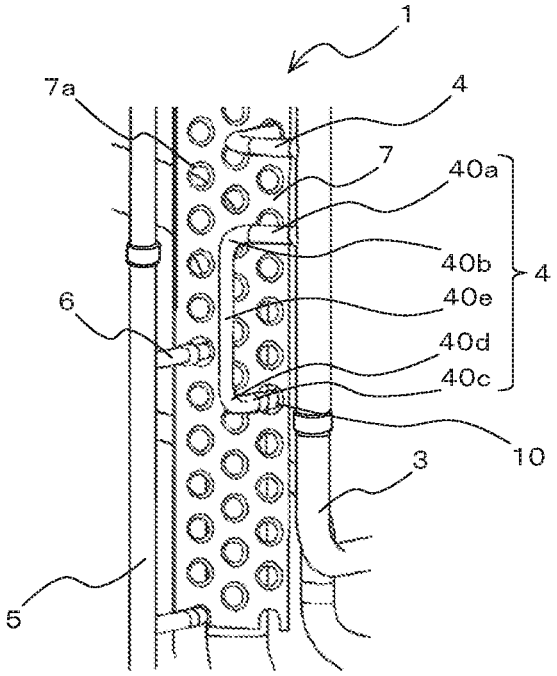
FIG. 4 is a schematic diagram illustrating an example of the configuration of first pass pipes 4 and a second pass pipe 6 which are located in the vicinity of an other end of each of the first header pipe 3 and the second header pipe 5 in the heat exchanger 1 according to embodiment 1 of the present invention.
Figure 5:
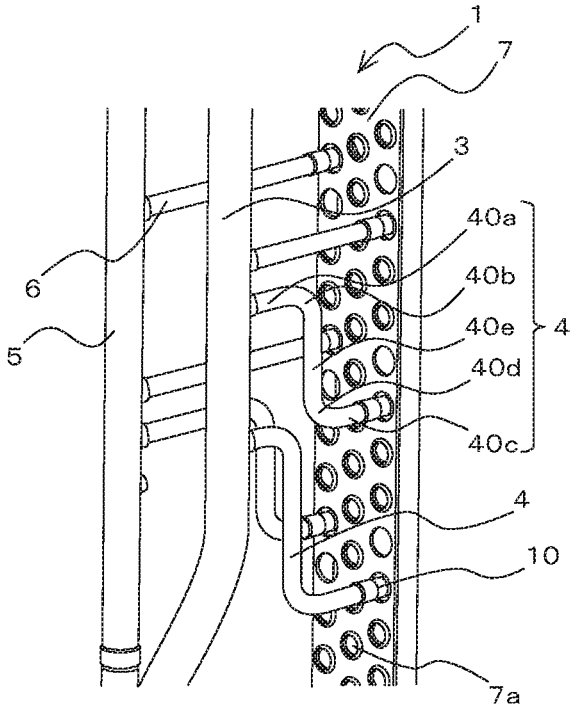
FIG. 5 is a schematic diagram illustrating another example of the configuration of the first pass pipes 4 and the second pass pipes 6 which are located in the vicinity of the other end of each of the first header pipe 3 and the second header pipe 5 in the heat exchanger 1 according to embodiment 1 of the present invention.

As illustrated in FIGS. 3 to 5, the first pass pipes 4 connected to the first header pipe 3 in the vicinity of the both ends thereof include the first pass pipes 4 each including a first straight pipe part 40*a*, a first bent pipe part 40*b*, a second straight pipe part 40*c*, a second bent pipe part 40*d* and a third straight pipe part 40*e*. In other words, the heat exchanger 1 as illustrated in FIGS. 3 to 5 includes one or more first pass pipes 4 having a bent pipe configuration.

In each of the first pass pipes 4, the first straight pipe part 40*a* extends in a direction away from the first header pipe 3; the first bent pipe part 40*b* extends from the first straight pipe part 40*a*; the second straight pipe part 40*c* is connected at the pipe junction 10, and extends in a direction away from the heat exchange portion 2; the second bent pipe part 40*d* extends from the second straight pipe part 40*c*; and the third straight pipe part 40*e* extends between the first bent pipe part 40*b* and the second bent pipe part 40*d*. The first straight pipe part 40*a*, the first bent pipe part 40*b*, the second straight pipe part 40*c*, the second bent pipe part 40*d* and the third straight pipe part 40*e* may be formed as a single body, or may be separate refrigerant pipes connected to one another.

Referring to FIG. 3, which illustrates the vicinity of the upper end of the first header pipe 3, the first straight pipe part 40*a* and the second straight pipe part 40*c* of each of first pass pipes 4 have a positional relationship in which they are not parallel to each other, and do not cross each other. Referring to FIG. 4, which illustrates the vicinity of the lower end of the first header pipe 3, the first straight pipe part 40*a* and the second straight pipe part 40*c* of a first pass pipe 4 have a positional relationship in which they are not parallel to each other, and do not cross each other. Referring to FIG. 5, which illustrates the vicinity of the lower end of the first header pipe 3, the first straight pipe part 40*a* and the second straight pipe part 40*c* of each of first pass pipes 4 have a positional relationship in which they are parallel to each other.

In the case where the heat exchanger 1 functions as a condenser and a high-temperature, high-pressure gas refrigerant flows into the first header pipe 3, there is a case where the temperature of the first header pipe 3 reaches, for example, approximately 100 degrees C., more specifically, a high temperature of 98 to 102 degrees C. For example, under a low temperature environment where outdoor air flowing between the plate-shaped fins 20 of the heat exchange portion 2 has a temperature of −15 degrees C., because of the difference in temperature between the pipe and the outdoor air, thermal expansion occurs and causes thermal strain in the first header pipe 3 and the first pass pipes 4.

The following description is given with respect to thermal strain which occurs in the first header pipe 3 and the first pass pipes 4 in the case where gas refrigerant having a temperature of 98 degrees C. has flowed into the first header pipe 3 and the temperature of outdoor air is −15 degrees C.

Figure 6:
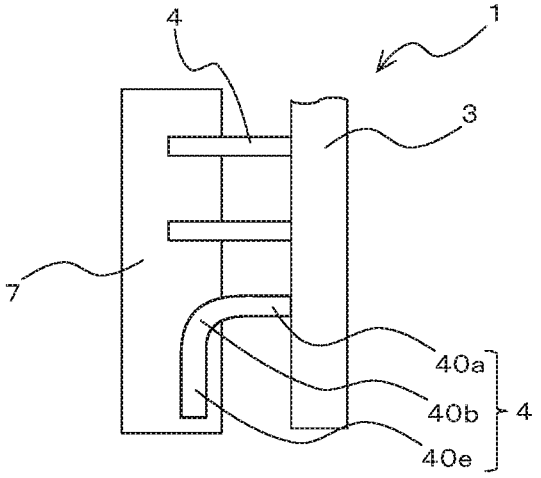
FIG. 6 is a schematic side view illustrating an example of the configuration of the first header pipe 3 and the first pass pipes 4 in the heat exchanger 1 according to embodiment 1 of the present invention in the case where a bending angle θ of a first bent pipe part 40*b* of the first pass pipe 4 is 90 degrees.
Figure 7:
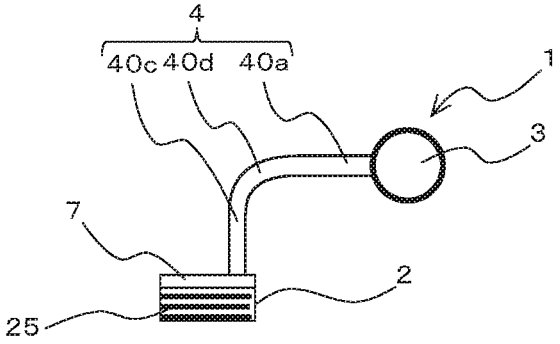
FIG. 7 is a schematic diagram illustrating the heat exchanger 1 as illustrated in FIG. 6, as viewed from below.

FIG. 6 is a schematic side view illustrating an example of the configurations of the first header pipe 3 and the first pass pipe 4 in the heat exchanger 1 according to embodiment 1 in the case where a bending angle θ of the first bent pipe part 40*b* is 90 degrees. FIG. 7 is a schematic diagram of the heat exchanger 1 of FIG. 6 as viewed from below. FIGS. 6 and 7 illustrate configurations corresponding to those of the first header pipe 3 and the first pass pipe 4 as illustrated in FIG. 4.

Figure 8:
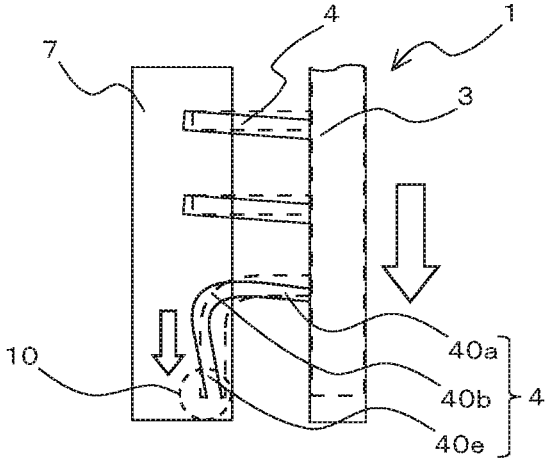
FIG. 8 is a side view schematically illustrating thermal strain which occur in the first header pipe 3 and the first pass pipes 4 in the heat exchanger 1 as illustrated in FIG. 6 in the case where a high-temperature, high-pressure gas refrigerant has flowed into the first header pipe 3.
Figure 9:
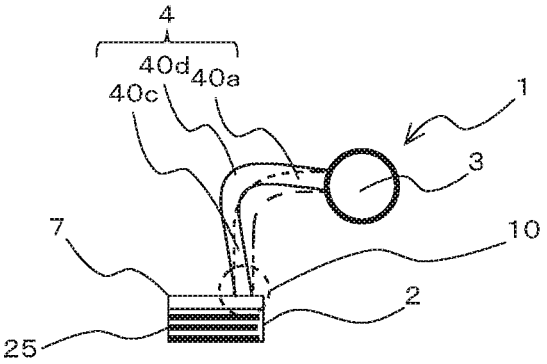
FIG. 9 is a schematic diagram illustrating the heat exchanger 1 as illustrated in FIG. 8, as viewed from below.

FIG. 8 is a side view schematically illustrating thermal strains which occur in the first header pipe 3 and the first pass pipes 4 in the case where a high-temperature, high-pressure gas refrigerant has flowed into the first header pipe 3 in the heat exchanger 1 of FIG. 6. FIG. 9 is a schematic diagram of the heat exchanger 1 as illustrated in FIG. 8, as viewed from below.

Referring to FIGS. 8 and 9, the pipe junction 10 has a configuration which is surrounded by a circular dashed line. Furthermore, as illustrated in FIGS. 8 and 9, after thermal strain occurs in the first header pipe 3 and the first pass pipes 4, the shapes thereof change to those as indicated by solid lines. In addition, in FIG. 8, directions in which a thermal stress caused by the thermal strain act on the first header pipe 3 and the first pass pipes 4 are indicated by hollow arrows.

It should be noted that in FIGS. 8 and 9, the shapes of the first header pipe 3 and the first pass pipes 4 in which thermal strain has not yet occurred are indicated by broken lines. The shapes of the first header pipe 3 and the first pass pipes 4 which are indicated by the broken lines in FIG. 8 are the same as those of the first header pipe 3 and the first pass pipes 4 as illustrated in FIG. 6. Also, the shapes of the first header pipe 3 and the first pass pipe 4 which are indicated by the broken lines in FIG. 9 are the same as those of the first header pipe 3 and the first pass pipe 4 as illustrated in FIG. 7.

As indicated by the hollow arrows in FIG. 8, in the first header pipe 3, thermal strain is caused by thermal expansion, and a thermal stress is generated by the thermal strain and acts in a direction along the central axis of the first header pipe 3.

Also, in the first pass pipes 4, thermal strain is caused by thermal expansion of the first pass pipes 4, and a thermal stress is generated by the thermal strain. In particular, as indicated by the hollow arrows in FIG. 8, in the first pass pipe 4 third straight pipe part, thermal strain is caused by thermal expansion of the third straight pipe part 40*e*, and a thermal stress is generated by the thermal strain and acts in the same direction as the thermal stress acts on the first header pipe 3. Therefore, in the pipe junction 10, the thermal stress generated on the first header pipe 3 and the thermal stress generated on the first pass pipe 4 are combined together, as a result of which the thermal stress on the pipe junction 10 becomes greater. If the thermal stress on the pipe junction 10 becomes greater, the pipe junction 10 may be cracked or broken due to thermal fatigue. Thus, there is a possibility that the reliability of the heat exchanger 1 cannot be maintained.

As illustrated in FIG. 9, in the first pass pipe 4, thermal strain is caused by thermal expansion of the first straight pipe part 40*a* and the second straight pipe part 40*c*, and a thermal stress is generated by the thermal strain and acts on the pipe junction 10. For example, the thermal strain of the first straight pipe part 40*a* generates a thermal stress which acts on the pipe junction 10 in a direction along the central axis of the first straight pipe part 40*a*, that is, a direction parallel to a surface of the side plate 7 and away from the first pass pipe 4. Also, the thermal strain of the second straight pipe part 40*c* generates a thermal stress which acts on the pipe junction 10 in a direction along the central axis of the second straight pipe part 40*c*, that is, a direction perpendicular to the surface of the side plate 7 and toward the surface of the side plate 7. However, the thermal stress generated on the pipe junction 10 by the thermal strain of the first straight pipe part 40*a* and the second straight pipe part 40*c* does not act in the same direction as the thermal stress generated on the first header pipe 3. Therefore, in the pipe junction 10, the thermal stress generated by the thermal strain of the first straight pipe part 40*a* and the second straight pipe part 40*c* is smaller than a combination of the thermal stress generated on the first header pipe 3 and that generated on the first pass pipe 4.

It should be noted that it is possible to reduce the thermal stress generated on the first straight pipe part 40*a* and the second straight pipe part 40*c* by decreasing the lengths of the first straight pipe part 40*a* and the second straight pipe part 40*c* in the directions along the central axes of the first straight pipe part 40*a* and first straight pipe part the second straight pipe part 40*cs*.

Figure 10:
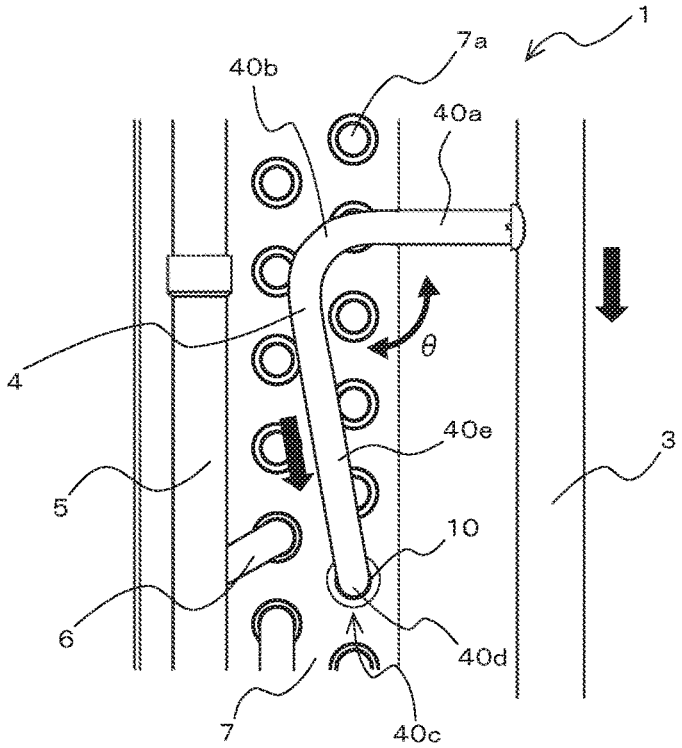
FIG. 10 is a schematic side view illustrating an example of the construction of the first header pipe 3 and the first pass pipe 4 in the heat exchanger 1 according to embodiment 1 of the present invention in the case where the bending angle θ of the first bent pipe part 40*b* of the first pipe 4 is less than 90 degrees.

FIG. 10 is a schematic side view illustrating an example of the configuration of the first header pipe 3 and the first pass pipe 4 in the heat exchanger 1 according to embodiment 1 in the case where the bending angle θ of the first bent pipe part 40*b* of the first pass pipe 4 is less than 90 degrees. In the first pass pipe 4 as illustrated in FIG. 10, the first straight pipe part 40*a* and the second straight pipe part 40*c* have a positional relationship in which they are not parallel to each other, and do not cross each other, and the configuration of the first pass pipe 4 as illustrated in FIG. 10 corresponds to that as illustrated in FIG. 4. In FIG. 10, directions in which thermal stresses generated by thermal strain acts on the first header pipe 3 and the first pass pipe 4 are indicated by black arrows. It should be noted that in FIG. 10, a structural element corresponding to the second straight pipe part 40*c* is not illustrated, and the position where the second straight pipe part 40*c* should be provided is thus indicated by an arrow.

Figure 11:
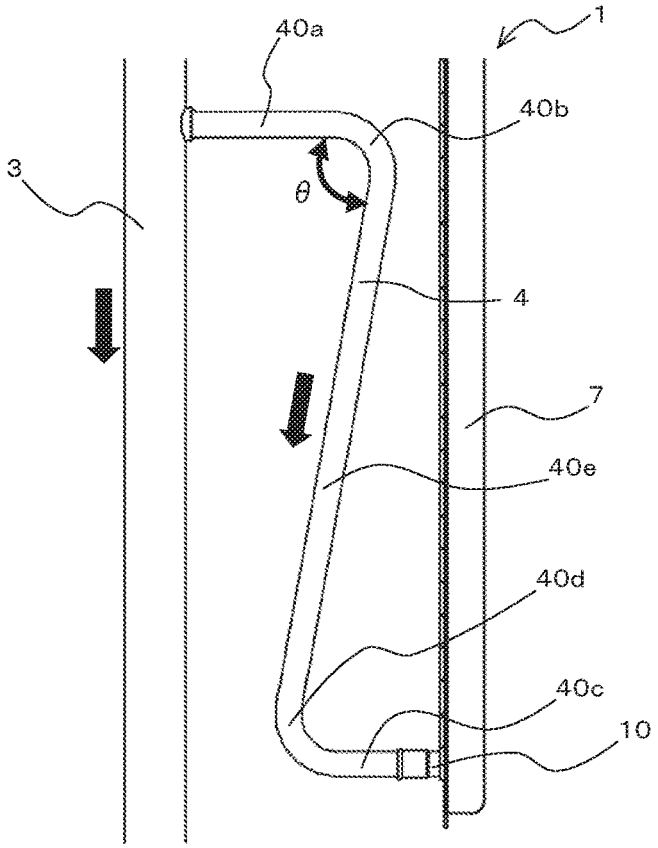
FIG. 11 is a schematic side view illustrating another example of the configuration of the first header pipe 3 and the first pass pipe 4 in the heat exchanger 1 according to embodiment 1 of the present invention in the case where the bending angle θ of the first bent pipe part 40*b* of the first pass pipe 4 is less than 90 degrees.

FIG. 11 is a schematic side view illustrating another example of the configuration of the first header pipe 3 and the first pass pipe 4 in the heat exchanger 1 according to embodiment 1 of the present invention in the case where the bending angle θ of the first bent pipe part 40*b* of the first pass pipe 4 is less than 90 degrees. The first pass pipe 4 as illustrated in FIG. 11 is formed such that the first straight pipe part 40*a* and the second straight pipe part 40*c* are parallel to each other, and has a configuration corresponding to that as illustrated in FIG. 5. In FIG. 11, the directions in which thermal stresses generated by thermal strain acts on the first header pipe 3 and the first pass pipe 4 are indicated by black arrows.

As indicated by the black arrows in FIGS. 10 and 11, in the first header pipe 3, thermal strain is caused by thermal expansion, and a thermal stress is generated by the thermal strain to act in the direction along the central axis of the first header pipe 3. Also, as indicated by the black arrows in FIGS. 10 and 11, in the first pass pipe 4, thermal strain is caused by thermal expansion of the third straight pipe part 40*e*, and a thermal stress is generated by the thermal strain and acts in the direction along the central axis of the third straight pipe part 40*e*.

However, referring to in FIGS. 10 and 11, in the case where the bending angle θ of the first bent pipe part 40*b* of the first pass pipe 4 is less than 90 degrees, the direction along the central axis of the third straight pipe part 40*e* is different from that along the central axis of the first header pipe 3. Referring to FIGS. 10 and 11, the thermal stress acting on the pipe junction 10 in the direction along the central axis of the first header pipe 3 is smaller than that in the case where the bending angle θ of the first bent pipe part 40*b* is 90 degrees. Therefore, by setting the bending angle θ of the first bent pipe part 40*b* to an angle of less than 90 degrees, it is possible to reduce the thermal stress on the pipe junction 10, thus reducing the possibility of the pipe junction 10 being cracked or broken due to thermal fatigue. It is therefore possible to maintain the reliability of the heat exchanger 1.

A refrigeration cycle apparatus 100 employing the heat exchanger 1 according to embodiment 1 will be described.

Figure 12:
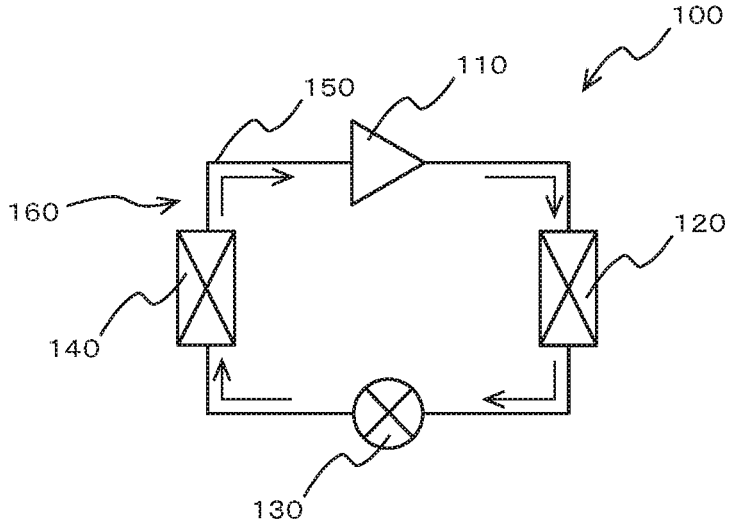
FIG. 12 is a refrigerant circuit diagram schematically illustrating an example of a refrigeration cycle apparatus 100 according to embodiment 1 of the present invention.

FIG. 12 is a refrigerant circuit diagram schematically illustrating an example of the refrigeration cycle apparatus 100 according to embodiment 1. The refrigeration cycle apparatus 100 includes a refrigeration cycle circuit 160 in which a compressor 110, a condenser 120, a pressure reducing device 130 and an evaporator 140 are connected by refrigerant pipes 150, and the refrigerant is circulated through the refrigerant pipes 150.

The compressor 110 is fluid machinery that compresses sucked low-pressure refrigerant into high-pressure refrigerant, and discharges the high-pressure refrigerant. The compressor 110 is, for example, a reciprocating compressor, a rotary compressor, or a scroll compressor. Furthermore, the compressor 110 may be a vertical compressor or a horizontal compressor.

The condenser 120 is configured as the heat exchanger 1, which is an air-cooled heat exchanger which causes heat exchange to be carried out between a high-temperature, high-pressure gas refrigerant flowing in the condenser 120 and low-temperature air passing through the condenser 120. In the refrigeration cycle apparatus 100, the condenser 120 may be referred to as a "radiator".

The pressure reducing device 130 is an actuator which expands high-pressure liquid refrigerant and reduces the pressure thereof. The pressure reducing device 130 can be formed as, for example, an expansion valve such as a linear electronic expansion valve whose opening degree can be adjusted in a stepwise manner or continuously, or an expansion device which is a mechanical expansion valve. In the refrigeration cycle apparatus 100, the linear electronic expansion valve may be abbreviated as "LEV".

The evaporator 140 is formed to cause heat exchange to be carried out between a low-temperature, low-pressure two-phase refrigerant flowing in the evaporator 140 and a high-temperature medium passing through the evaporator 140. For example, the evaporator 140 can be formed as an air-cooled heat exchanger which causes heat exchange to be carried out between the low-temperature, low-pressure two-phase refrigerant flowing in the evaporator 140 and the high-temperature air passing through the evaporator 140. Furthermore, the evaporator 140 can be formed as a water-cooled heat exchanger which causes heat exchange to be carried out between the low-temperature, low-pressure two-phase refrigerant flowing in the evaporator 140 and, for example, water or brine flowing in the evaporator 140. In the case where the evaporator 140 is an air-cooled heat exchanger, the evaporator 140 can be formed as, for example, a cross-fin type fin-and-tube heat exchanger like the heat exchanger 1. In the case where the evaporator 140 is a water-cooled heat exchanger, the evaporator 140 can be formed as, for example, a plate type heat exchanger or a double-pipe heat exchanger. In the refrigeration cycle apparatus 100, the evaporator 140 may be referred to as a "cooler".

An operation of the refrigeration cycle apparatus 100 will be described. In FIG. 12, flow directions of refrigerant are indicated by arrows.

A high-temperature, high-pressure gas refrigerant discharged from the compressor 110 flows into the condenser 120. In the condenser 120, the high-temperature, high-pressure gas refrigerant transfers heat to the low-temperature medium to exchange heat therewith, and as a result changes into a high-pressure liquid refrigerant. The high-pressure liquid refrigerant flows into the pressure reducing device 130. In the pressure reducing device 130, the high-pressure liquid refrigerant is expanded and reduced in pressure, and as a result it changes into a low-temperature, low-pressure two-phase refrigerant. The low-temperature, low-pressure two-phase refrigerant flows into the evaporator 140. In the evaporator 140, the low-temperature, low-pressure two-phase refrigerant receives heat from the high-temperature medium and thus evaporates, and as a result it changes into a high-quality, two-phase refrigerant or low-temperature, low-pressure gas refrigerant. The high-quality, two-phase refrigerant or low-temperature, low-pressure gas refrigerant flows out of the evaporator 140, and is sucked into the compressor 110. In the compressor 110, the high-quality, two-phase refrigerant or low-temperature, low-pressure gas refrigerant is compressed into a high-temperature, high-pressure gas refrigerant, and then discharged from the compressor 110. In the refrigeration cycle apparatus 100, the above cycle is repeated.

In the case where the refrigeration cycle apparatus 100 performs a cooling operation for giving cooling energy to a user, the condenser 120 serves as a heat source-side heat exchanger, and the evaporator 140 serves as a load side-heat exchanger. In the case where the refrigeration cycle apparatus 100 performs a heating operation for giving heating energy to the user, the condenser 120 serves as a load-side heat exchanger, and the evaporator 140 serves as a heat source-side heat exchanger. In the refrigeration cycle apparatus 100, the load-side heat exchanger may be referred to as a "use-side heat exchanger".

In the case where the refrigeration cycle apparatus 100 is formed as, for example, an air-conditioning apparatus, it can be designed such that although it is not illustrated in FIG. 1, a refrigerant flow switching device such as a four-way valve is disposed in the refrigeration cycle circuit 160 to enable the air-conditioning apparatus to switch its operation between the cooling operation and the heating operation. Furthermore, the refrigeration cycle apparatus 100 can be formed such that an accumulator is disposed in the refrigerant pipe 150 connecting the evaporator 140 and the compressor 110 to separate a liquid-phase component from the refrigerant flowing out from the evaporator 140. In the case where the evaporator 140 is formed as an air-cooled heat exchanger, it can be designed such that the refrigeration cycle apparatus 100 is provided with a fan such as a propeller fan, and air is supplied to the evaporator 140 by rotating the fan. Furthermore, the refrigeration cycle apparatus 100 may include a liquid receiver, an oil separator, a subcooling heat exchanger, etc., in addition to the above components.

Furthermore, the refrigeration cycle apparatus 100 may be formed such that a plurality of condensers 120 or a plurality of evaporators 140 are arranged in parallel with each other in the refrigeration cycle circuit 160 or such that a plurality of pressure reducing devices 130 are arranged in the refrigeration cycle circuit 160. Furthermore, the refrigeration cycle apparatus 100 may include a plurality of refrigeration cycle circuits 160.

The structure of a refrigeration apparatus 200 will be described as an example of the refrigeration cycle apparatus 100 according to embodiment 1.

Figure 13:
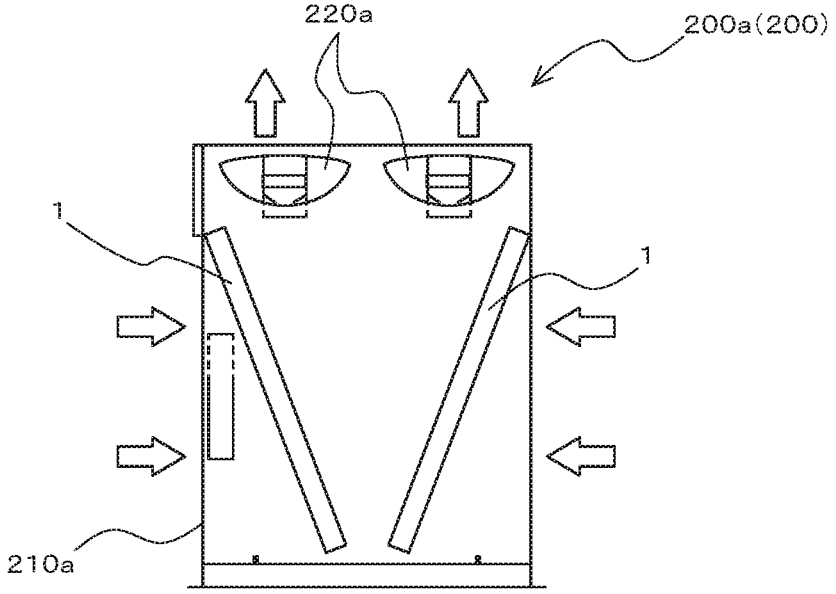
FIG. 13 is a schematic diagram illustrating an internal configuration of an outdoor condensing unit 200*a* of an indoor refrigeration apparatus, which is an example of a refrigeration apparatus 200 according to embodiment 1 of the present invention.

FIG. 13 is a schematic diagram illustrating the internal configuration of an outdoor condensing unit 200*a* of an indoor refrigeration apparatus, which is an example of the refrigeration apparatus 200 according to embodiment 1. In FIG. 13, flow directions of air during driving of the outdoor condensing unit 200*a* of the indoor refrigeration apparatus are indicated by hollow arrows.

As illustrated in FIG. 13, the outdoor condensing unit 200*a* of the indoor refrigeration apparatus can be formed such that two heat exchangers 1, each serving as the condenser 120, are spaced apart from each other, and arranged in a V-shaped pattern in, for example, a cuboid casing 210*a*. Also, the outdoor condensing unit 200*a* can be formed such that one or more air-sending fans 220*a* such as propeller fans are arranged in upper part of the casing 210*a*.

In the outdoor condensing unit 200*a* of the indoor refrigeration apparatus, indoor air is taken into an internal space of the casing 210*a* through side surface portions of the casing 210*a* by rotating the air-sending fans 220*a*. The air taken into the internal space of the casing 210*a* passes through the heat exchangers 1, and exchanges heat with the high-temperature, high-pressure gas refrigerant flowing in the heat exchangers 1. After the heat exchange, the air from one of the two heat exchangers 1 and the air from the other heat exchanger 1 join together in the space between the two heat exchangers 1, and is then discharged from an upper surface portion of the casing 210*a* to outside air by rotating the air-sending fans 220*a*.

Figure 14:
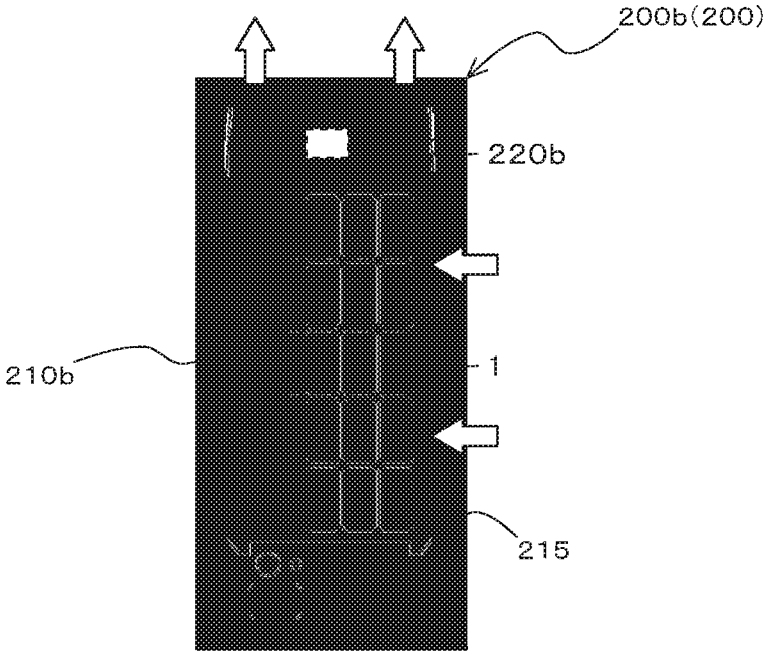
FIG. 14 is a schematic diagram illustrating an external appearance of an outdoor refrigeration apparatus 200*b*, which is another example of the refrigeration apparatus 200 according to embodiment 1 of the present invention.

FIG. 14 is a schematic diagram illustrating the external appearance of an outdoor refrigeration apparatus 200*b*, which is an example of the refrigeration apparatus 200 according to embodiment 1. In FIG. 14, flow directions of air during driving of the outdoor refrigeration apparatus 200*b* are indicated by hollow arrows.

As illustrated in FIG. 14, the outdoor refrigeration apparatus 200*b* can be formed such that the heat exchanger 1, which is formed as the condenser 120, is disposed in, for example, a cuboid casing 210*b*. The heat exchanger 1 can be disposed on an internal surface side of a side portion of the casing 210*b* which includes a plurality of rectangular openings 215 as illustrated in, for example, FIG. 14. Also, the outdoor refrigeration apparatus 200*b* can be formed such that one or more air-sending fans 220*b* such as propeller fans are arranged in upper part of the casing 210*b*. The heat exchanger 1 may be disposed at one side portion of the casing 210*b* or may be disposed at a plurality of side portions of the casing 210*b*.

In the outdoor refrigeration apparatus 200*b*, outdoor air is taken from the side surface portion of the casing 210*b* into an internal space thereof through the openings 215 of the side portion of the casing 210*b* by rotating the air-sending fans 220*b*. The air taken into the internal space of the casing 210*b* passes through the heat exchanger 1, and exchanges heat with the high-temperature, high-pressure gas refrigerant flowing in the heat exchanger 1. After the heat exchange, the air is discharged from upper part of the casing 210*b* into outside air by rotating the air-sending fans 220*b*.

As described above, the heat exchanger 1 according to embodiment 1 includes: the heat exchange portion 2 which includes the plate-shaped fins 20 spaced from each other and parallel to each other and the heat transfer pipes 25 intersecting the plate-shaped fins 20; the first header pipe 3 which is a header pipe for supplying the refrigerant to the heat exchange portion 2; and the first pass pipes 4 which are pass pipes connected between the heat exchange portion 2 and the first header pipe 3. The first pass pipes 4 include at least one first pass pipe 4 including the first straight pipe part 40*a* extending in a direction away from the first header pipe 3, the first bent pipe part 40*b* extending from the first straight pipe part 40*a*, the second straight pipe part 40*c* extending in a direction away from the pipe junction 10 at which the heat exchange portion 2 and the second straight pipe part 40*c* are connected to each other, the second bent pipe part 40*d* extending from the second straight pipe part 40*c*, and the third straight pipe part 40*e* extending between the first bent pipe part 40*b* and the second bent pipe part 40*d*. The bending angle θ of the first bent pipe part 40*b* is less than 90 degrees.

The refrigeration cycle apparatus 100 according to embodiment 1 includes the above heat exchanger 1.

In the configuration according to embodiment 1, the bending angle θ of the first bent pipe part 40*b* of the first pass pipe 4 is less than 90 degrees, whereby the direction along the central axis of the third straight pipe part 40*e* differs from that along the central axis of the first header pipe 3. Thus, thermal stress which acts on the pipe junction 10 in the direction along the central axis of the first header pipe 3 is smaller than that in the case where the bending angle θ of the first bent pipe part 40*b* is 90 degrees. Therefore, by setting the bending angle θ of the first bent pipe part 40*b* to an angle of less than 90 degrees, it is possible to reduce the thermal stress on the pipe junction 10, thus reducing the possibility of the pipe junction 10 being cracked or broken due to thermal fatigue. The reliability of the heat exchanger 1 can thus be maintained.

Embodiment 2

A heat exchanger 1 according to embodiment 2 of the present invention will be described. The heat exchanger 1 according to embodiment 2 is a modification of the heat exchanger 1 according to embodiment 1 as described above; that is, in the heat exchanger 1 according to embodiment 2, the bending angle θ of the first bent pipe part 40*b* is optimized. In embodiment 2, the structure of the heat exchanger 1 is the same as that of the heat exchanger 1 according to embodiment 1 as described above, except for the bending angle θ of the first bent pipe part 40*b*, and its description will thus be omitted.

In embodiment 2, in order to achieve optimization of the bending angle θ of the first bent pipe part 40*b* of the first pass pipe 4, the relationship between the bending angle θ of the first bent pipe part 40*b* of the first pass pipe 4 and thermal stress on a pipe junction 10 was actually measured by a thermal stress analysis.

The analysis of thermal stress in the heat exchanger 1 was conducted under natural convection conditions. The temperature of gas refrigerant was set to 98 degrees C., and the temperature of liquid refrigerant was set to 57 degrees C. The temperature of outdoor air was set to −15 degrees C. Heat transfer pipes 25 were made of copper and formed to have a diameter of 19.05 mm and a thickness of 1.0 mm. The first pass pipes 4 were made of copper and formed to have a diameter of 7.94 mm and a thickness of 0.7 mm. The coefficient of heat transfer of the heat exchanger 1 was set to 5 $W/m^2 \cdot K$.

Figure 15:
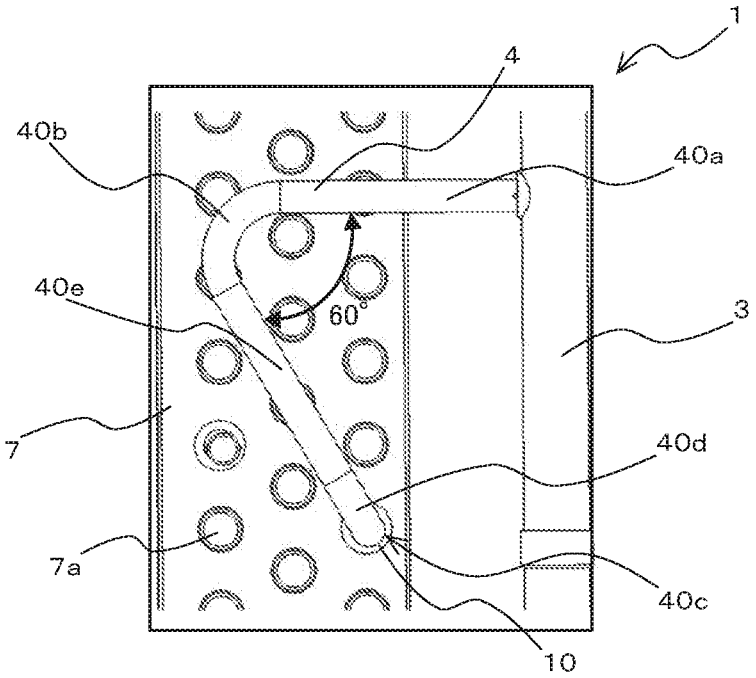
FIG. 15 is a schematic side view illustrating an example of the configuration of a first header pipe 3 and a first pass pipe 4 in a heat exchanger 1 according to embodiment 2 of the present invention in the case where the bending angle θ of a first bent pipe part 40*b* of the first pass pipe 4 is 60 degrees.
Figure 16:
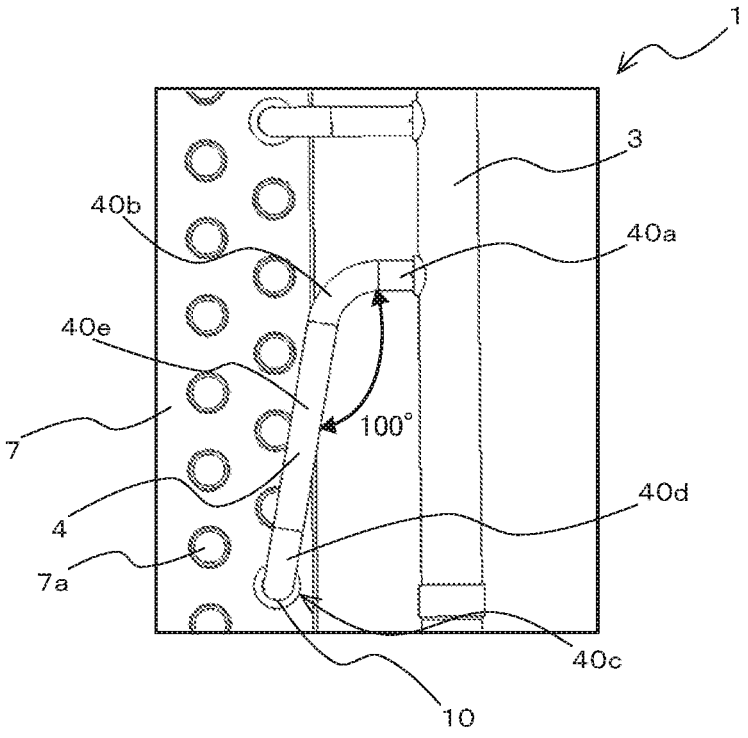
FIG. 16 is a schematic side view illustrating an example of the configuration of the first header pipe 3 and the first pass pipe 4 in the heat exchanger 1 according to embodiment 2 of the present invention in the case where the bending angle θ of the first bent pipe part 40*b* of the first pass pipe 4 is 100 degrees.

FIG. 15 is a schematic side view illustrating an example of the configuration of the first header pipe 3 and the first pass pipe 4 in the heat exchanger 1 according to embodiment 2 in the case where the bending angle θ of the first bent pipe part 40*b* is 60 degrees. FIG. 16 is a schematic side view illustrating an example of the configuration of the first header pipe 3 and the first pass pipe 4 in the heat exchanger 1 according to embodiment 2 in the case where the bending angle θ of the first bent pipe part 40*b* of the first pipe 4 is 100 degrees. In other words, FIG. 15 illustrates an example of the configuration of the first pass pipe 4 in the case where bending angle θ of the first bent pipe part 40*b* of the first pass pipe 4 is an acute angle, and FIG. 16 illustrates an example of the configuration of the first pass pipe 4 in the case where the bending angle θ of the first bent pipe part 40*b* is an obtuse angle. In embodiment 2, the bending angle θ of the first bent pipe part 40*b* of the first pass pipe 4, which is a parameter, was changed as illustrated in FIGS. 15 and 16, to analyze the thermal stress on the pipe junction 10 in the heat exchanger 1.

Figure 17:
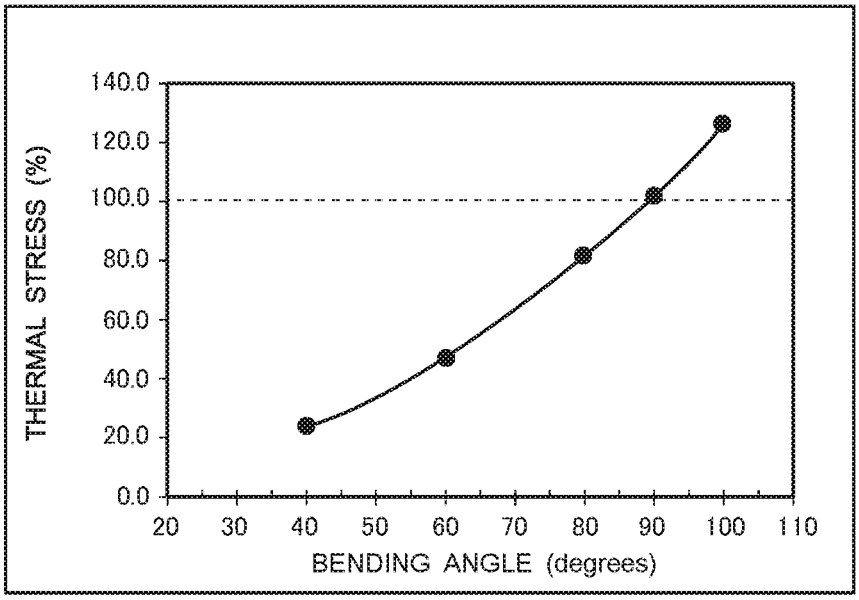
FIG. 17 is a graph showing the relationship between the bending angle θ of the first bent pipe part 40*b* of the first pass pipe 4 and the thermal stress on a pipe junction 10 in the heat exchanger 1 according to embodiment 2 of the present invention.

FIG. 17 is a graph showing the relationship between the bending angle θ of the first bent pipe part 40*b* of the first pass pipe 4 and the thermal stress on the pipe junction 10 in the heat exchanger 1 according to embodiment 2. The horizontal axis of the graph of FIG. 17 represents the bending angle θ of the first bent pipe part 40*b* of the first pass pipe 4. The vertical axis of the graph of FIG. 17 represents a normalized value of thermal stress which is normalized with reference to an allowable limit of the thermal stress on the pipe junction 10 where the allowable limit is 100%. In the graph of FIG. 17, a horizontal dashed line indicates that the normalized value of a thermal stress is 100%.

As illustrated in FIG. 17, in the case where the bending angle θ of the first bent pipe part 40*b* of the first pass pipe 4 is greater than or equal to 85 degrees, the normalized value of the thermal stress exceeds 100%, thus increasing the possibility of the pipe junction 10 being cracked or broken due to thermal fatigue.

Figure 18:
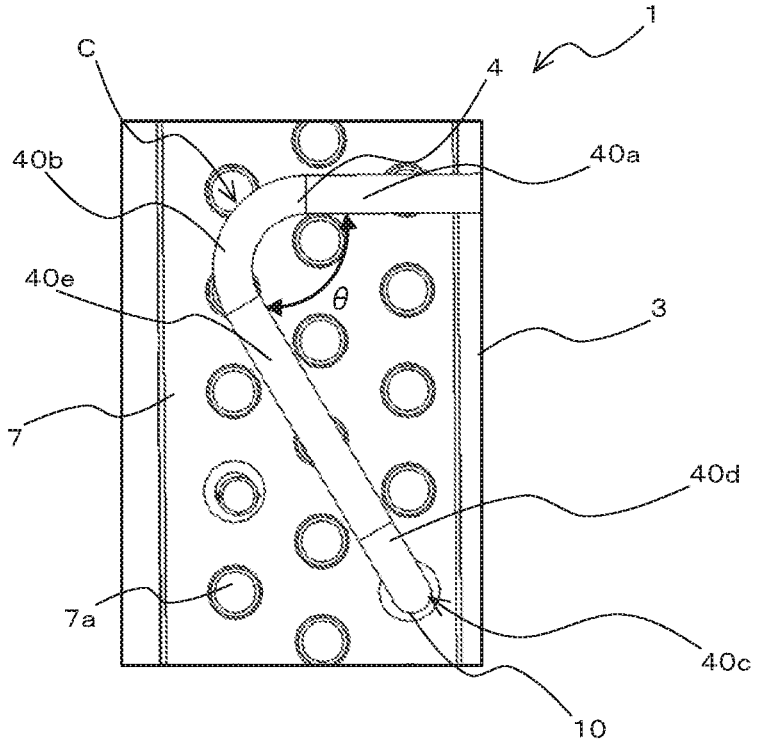
FIG. 18 is a schematic side view illustrating an example of the configuration of the first pass pipe 4 in the heat exchanger 1 according to embodiment 2 of the present invention in the case where the bending angle θ of the first bent pipe part 40*b* of the first pass pie 4 is an acute angle.

Furthermore, in embodiment 2, in order to achieve optimization of the bending angle θ of the first bent pipe part 40*b* of the first pass pipe 4, the relationship between the bending angle θ of the first bent pipe part 40*b* of the first pass pipe 4 and thermal stress on the first bent pipe part 40*b* was actually measured by the thermal stress analysis. FIG. 18 is a schematic side view illustrating an example of the configuration of the first bent pipe part 40*b* of the first pass pipe 4 in the heat exchanger 1 according to embodiment 2 in the case where the bending angle θ is an acute angle. As illustrated in FIG. 18, the thermal stress on the first bent pipe part 40*b* was measured at outermost part C of the first bent pipe part 40*b*. It should be noted that the analysis of the thermal stress in the heat exchanger 1 was made under the same conditions as in the pipe junction 10 as described above.

Figure 19:
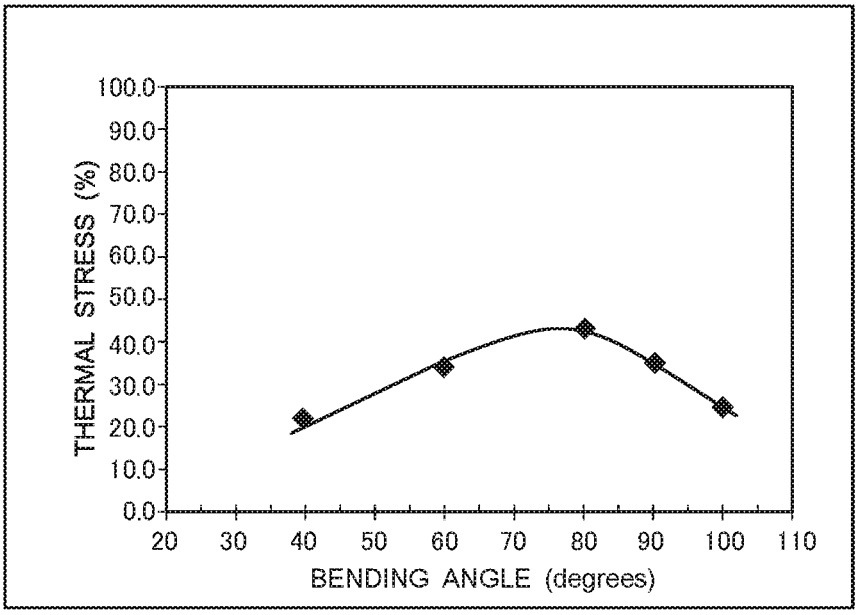
FIG. 19 is a graph showing the relationship between the bending angle θ of the first bent pipe part 40*b* of the first pass pipe 4 and the thermal stress on the first bent pipe part 40*b* in the heat exchanger 1 according to embodiment 2 of the present invention.

FIG. 19 is a graph showing the relationship between the bending angle θ of the first bent pipe part 40*b* of the first pass pipe 4 and the thermal stress on the first bent pipe part 40*b* in the heat exchanger 1 according to embodiment 2. The horizontal axis of the graph of FIG. 17 represents the bending angle θ of the first bent pipe part 40*b* of the first pass pipe 4. The vertical axis of the graph of FIG. 19 represents a normalized value of thermal stress which is normalized with an allowable limit of thermal stress on the first bent pipe part 40*b* where the allowable limit is 100%.

As illustrated in FIG. 19, even when the bending angle θ of the first bent pipe part 40*b* of the first pass pipe 4 is changed, the normalized value of the thermal stress on the first bent pipe part 40*b* is less than 50%. Therefore, the possibility of the first bent pipe part 40*b* being cracked or broken due to thermal fatigue is slight.

Therefore, the possibility of both the pipe junction 10 and the first bent pipe part 40*b* being cracked or broken due to thermal fatigue is reduced by setting the bending angle θ of the first bent pipe part 40*b* of the first pass pipe 4 to less than 85 degrees.

Figure 20:
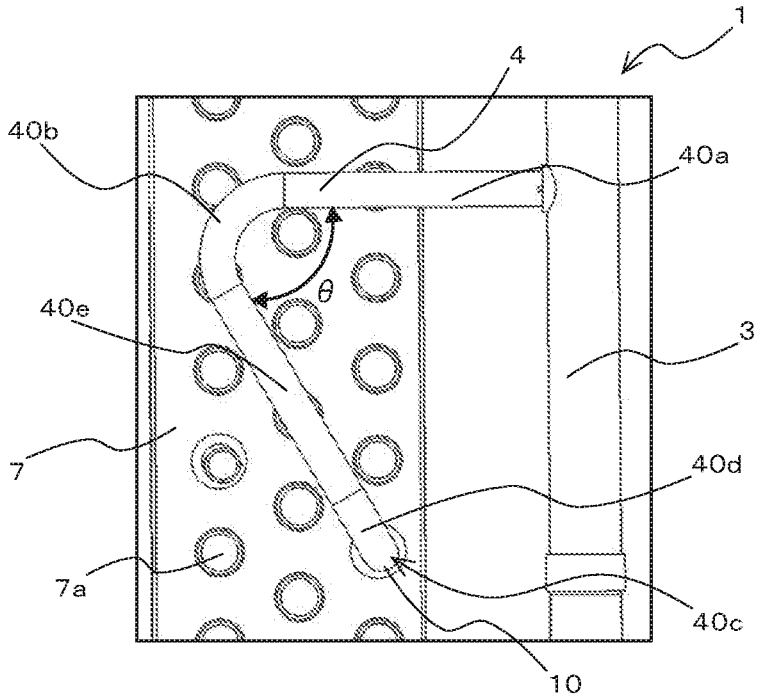
FIG. 20 is a schematic side view illustrating another example of the configuration of the first bent pipe part 40*b* of the first pass pipe 4 in the heat exchanger 1 according to embodiment 2 of the present invention in the case where the bending angle θ of the first bent pipe part 40*b* of the first pass pipe 4 is an acute angle.

The relationship between the bending angle θ of the first bent pipe part 40*b* of the first pass pipe 4 and a resonance frequency of the first pass pipe 4, which is an inherent value of the first pass pipe 4, will be described with reference to FIGS. 20 and 21. FIG. 20 is a schematic side view illustrating another example of the configuration of the first bent pipe part 40*b* of the first pass pipe 4 in the heat exchanger 1 according to embodiment 2 in the case where the bending angle θ of the first bent pipe part 40*b* of the first pass pipe 4 is an acute angle. The configuration of the first pass pipe 4 as illustrated in FIG. 20 is the same as that as illustrated in FIG. 18, except for the outermost part C of the first bent pipe part 40*b*, which is not illustrated in FIG. 20.

Referring to FIG. 20, the heat transfer pipes 25 is made of copper and also made to have a diameter of 19.05 mm and a thickness of 1.0 mm. The first pass pipe 4 is made of copper and made to have a diameter of 7.94 mm and a thickness of 0.7 mm.

Figure 21:
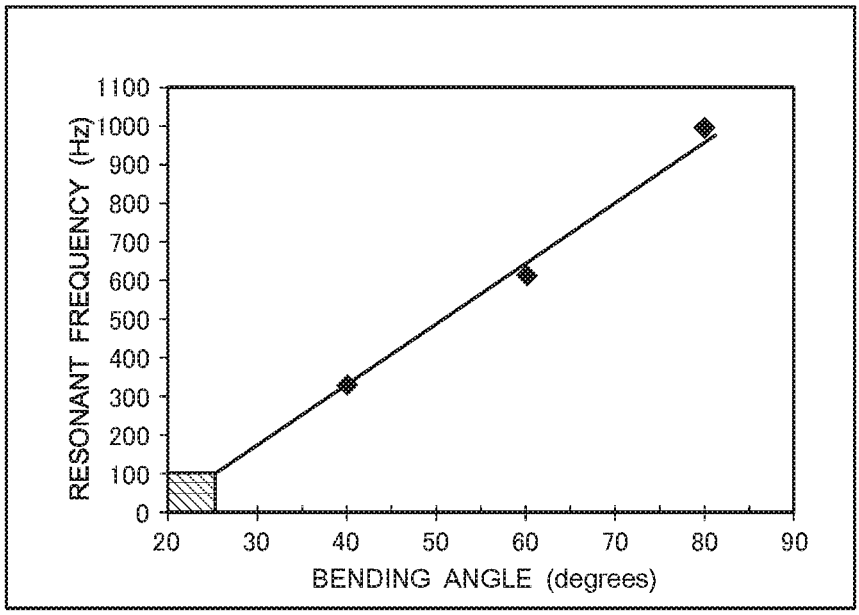
FIG. 21 is a graph showing the relationship between the bending angle θ of the first bent pipe part 40*b* of the first pass pipe 4 and a resonance frequency of the first pass pipe 4 in the heat exchanger 1 according to embodiment 2 of the present invention.

FIG. 21 is a graph showing the relationship between the bending angle θ of the first bent pipe part 40*b* of the first pass pipe 4 and the resonance frequency of the first pass pipe 4 in the heat exchanger 1 according to embodiment 2. The horizontal axis of the graph of FIG. 21 represents the bending angle θ of the first bent pipe part 40*b* of the first pass pipe 4. The vertical axis of the graph of FIG. 21 represents the resonance frequency of the first pass pipe 4, which is expressed in hertz. In the graph of FIG. 21, a hatched portion indicates a range within which bending angle θ of the first bent pipe part 40*b* falls to cause the resonant frequency to be 100 Hz or less.

As illustrated in FIG. 21, when the bending angle θ of the first bent pipe part 40*b* of the first pass pipe 4 is 25 degrees or less, the resonant frequency of the first pass pipe 4 is 100 Hz or less. In the refrigeration cycle apparatus 100 including the heat exchanger 1, the operation frequency of the compressor 110 is 100 Hz at the maximum. Thus, when the bending angle θ of the first bent pipe part 40*b* is 25 degrees or less, the first pass pipe 4 may be cracked or broken due to resonance of the first pass pipe 4.

Therefore, in the heat exchanger 1 according to embodiment 2, by setting the bending angle θ of the first bent pipe part 40*b* of the first pass pipe 4 to an angle greater than 25 degrees and less than 85 degrees, it is possible to reduce the possibility of the first pass pipe 4 being cracked or broken due to thermal fatigue or a combination of resonance and thermal stress.

Embodiment 3

A heat exchanger 1 according to embodiment 3 of the present invention will be described. The heat exchanger 1 according to embodiment 3 is a modification of the heat exchangers 1 according to embodiments 1 and 2 as described above, in which the bending angle θ of the first bent pipe part 40*b* is further optimized. In embodiment 3, the configuration of the heat exchanger 1 is the same as those of the heat exchangers 1 according to embodiments 1 and 2 described above, except for the bending angle θ of the first bent pipe part 40*b*, and its description will thus be omitted.

Figure 22:
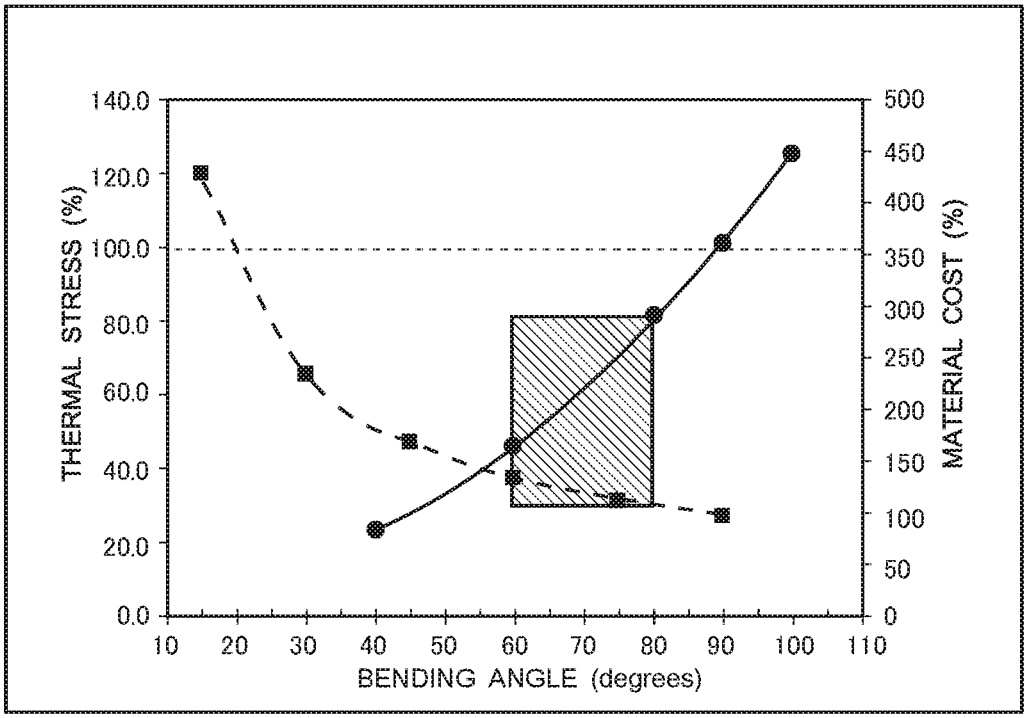
FIG. 22 is a graph showing the relationship between the bending angle θ of a first bent pipe part 40*b* of a first pass pipe 4, the thermal stress on a pipe junction 10 and the material cost of the first pass pipe 4 in a heat exchanger 1 according to embodiment 3 of the present invention.

FIG. 22 is a graph showing a relationship between the bending angle θ of the first bent pipe part 40*b* of the first pass pipe 4, the thermal stress on the pipe junction 10 and the material cost of the first pass pipe 4 in the heat exchanger 1 according to embodiment 3. The horizontal axis of the graph of FIG. 22 represents the bending angle θ of the first bent pipe part 40*b* of the first pass pipe 4. The left vertical axis of the graph represents a normalized value of the thermal stress which is normalized with reference to an allowable limit of thermal stress on the pipe junction 10 where the allowable limit is 100%. The right vertical axis of the graph of FIG. 22 represents a normalized value of the material cost of the first pass pipe 4 which is normalized with reference to the material cost of the first pass pipe 4 where the material cost of the first pass pipe 4 is 100% in the case where the bending angle θ of the first bent pipe part 40*b* is 90 degrees.

In the graph of FIG. 22, a solid line indicates the relationship between the bending angle θ of the first bent pipe part 40*b* of the first pass pipe 4 and the thermal stress on the pipe junction 10, and a broken line indicates the relationship between the bending angle θ of the first bent pipe part 40*b* of the first pass pipe 4 and the material cost. In the graph of FIG. 22, a hatched portion indicates an optimum range of the bending angle θ, that of the normalized value of the thermal stress and that of the normalized value of the material cost. Additionally, in the graph of FIG. 22, a horizontal dashed line indicates that the normalized value of a thermal stress is 100%.

As illustrated in FIG. 22, in the case where the bending angle θ of the first bent pipe part 40*b* is set to 60 degrees or less, the thermal stress acting on the pipe junction 10 is decreased, but the material cost of the first pass pipe 4 is increased by 50% or more since the length of the first pass pipe 4 is increased.

In embodiment 2 described above, assuming that the factor of safety of the pipe junction 10 against the thermal stress and the factor of safety of the first pass pipe 4 against the resonance frequency and the thermal stress are each 1.2, an optimum value of the bending angle θ of the first bent pipe part 40*b* is greater than 28 degrees and less than 80 degrees. When the bending angle θ of the first bent pipe part 40*b* is set greater than 28 degrees and less than 80 degrees, the possibility of the first pass pipe 4 being cracked or broken due to thermal fatigue or resonance can be further reduced.

Therefore, in the heat exchanger 1 according to embodiment 3, by setting the bending angle θ of the first bent pipe part 40*b* of the first pass pipe 4 to an angle greater than 60 degrees and less than 80 degrees, it is possible to reduce the possibility of the first pass pipe 4 being cracked or broken due to thermal fatigue or resonance. It is also possible to reduce the degree by which the material cost of the first pass pipe 4 is increased to less than 50%. Therefore, in the heat exchanger 1 according to embodiment 3, it is possible to reduce the degree of increasing of the material cost of the first pass pipe 4, and also further reduce the possibility of the first pass pipe 4 being cracked or broken due to thermal fatigue or resonance.

Other Embodiments

The present invention is not limited to the above embodiments, and can be variously modified without departing from the spirit and scope of the present invention. For example, although in the above explanations of the embodiments, the refrigeration apparatus 200 is described as an example of the refrigeration cycle apparatus 100, the present invention can be applied to another type of refrigeration cycle apparatus 100 which is an apparatus other than the refrigeration apparatus 200, for example, an air-conditioning apparatus.

Although it is not illustrated, the plate-shaped fins 20 each may include a heat transfer promoting portion in which ridges and valleys are alternately arranged, and they may be formed to promote heat transfer in the plate-shaped fin 20. Furthermore, the heat transfer pipes 25 may be formed as flat pipes.

REFERENCE SIGNS LIST

1 heat exchanger 2 heat exchange portion 3 first header pipe 4 first pass pipe 4*a* end portion 5 second header pipe 6 second pass pipe 7 side plate 7*a* punched hole 10 pipe junction 20 plate-shaped fin 25 heat transfer pipe 25*a* end 40*a* first straight pipe part 40*b* first bent pipe part 40*c* second straight pipe part 40*d* second bent pipe part 40*e* third straight pipe part 100 refrigeration cycle apparatus 110 compressor 120 condenser 130 pressure reducing device 140 evaporator 150 refrigerant pipe 160 refrigeration cycle circuit 200 refrigeration apparatus 200*a* outdoor condensing unit 200*b* outdoor refrigeration apparatus 210*a*, 210*b* casing 215 opening 220*a*, 220*b* air-sending fan

The invention claimed is:

1. A heat exchanger comprising:

a heat exchange portion including a plurality of plate-shaped fins and a plurality of heat transfer pipes, the plurality of plate-shaped fins being spaced apart from each other and parallel to each other, the plurality of heat transfer pipes intersecting the plurality of plate-shaped fins;

a header pipe configured to supply refrigerant to the heat exchange portion; and a plurality of pass pipes connected between the heat exchange portion and the header pipe, wherein one or more pass pipes of the plurality of pass pipes include a first straight pipe part extending in a direction away from the header pipe, a first bent pipe part extending from the first straight pipe part, a second straight pipe part extending in a direction away from a pipe junction at which the heat exchange portion and the second straight pipe part are connected to each other, a second bent pipe part extending from the second straight pipe part, and a third straight pipe part extending between the first bent pipe part and the second bent pipe part, wherein a bending angle of the first bent pipe part is less than 90 degrees, and wherein the third straight pipe part has a central axis different from a central axis of the header pipe.

2. The heat exchanger of claim 1, wherein the second straight pipe part and the first straight pipe part are located not parallel to each other and not to cross each other.

3. The heat exchanger of claim 1, wherein the second straight pipe part is parallel to the first straight pipe part.

4. The heat exchanger of claim 1, wherein the bending angle is greater than 25 degrees and less than 85 degrees.

5. The heat exchanger of claim 1, wherein the bending angle is greater than 60 degrees and less than 80 degrees.

6. A refrigeration cycle apparatus comprising the heat exchanger of claim 1.

7. The heat exchanger of claim 1, wherein the third straight pipe part extends closer to the header pipe in a direction from the first bent pipe part toward the second bent pipe part.

8. A heat exchanger comprising:

a heat exchange portion including a plurality of plate-shaped fins and a plurality of heat transfer pipes, the plurality of plate-shaped fins being spaced apart from each other and parallel to each other, the plurality of heat transfer pipes intersecting the plurality of plate-shaped fins;

a header pipe configured to supply refrigerant to the heat exchange portion; and a plurality of pass pipes connected between the heat exchange portion and the header pipe, wherein one or more pass pipes of the plurality of pass pipes include a first straight pipe part extending in a direction away from the header pipe, a first bent pipe part extending from the first straight pipe part, a second straight pipe part extending in a direction away from a pipe junction at which the heat exchange portion and the second straight pipe part are connected to each other, a second bent pipe part extending from the second straight pipe part, and a third straight pipe part extending between the first bent pipe part and the second bent pipe part, and wherein a bending angle of the first bent pipe part is greater than 25 degrees and less than 85 degrees.

* * * * *